US007213350B2

(12) United States Patent
Brown

(10) Patent No.: US 7,213,350 B2
(45) **Date of Patent: *May 8, 2007**

(54) SHOCK REDUCING FOOTWEAR

(75) Inventor: Jeffrey W. Brown, Mesa, AZ (US)

(73) Assignee: B & B Technologies LP, Mesa, AZ (US)

( * ) Notice: Subject to any disclaimer, the term of this patent is extended or adjusted under 35 U.S.C. 154(b) by 374 days.

This patent is subject to a terminal disclaimer.

(21) Appl. No.: 10/682,358

(22) Filed: Oct. 10, 2003

(65) Prior Publication Data

US 2004/0107602 A1 Jun. 10, 2004

Related U.S. Application Data

(63) Continuation-in-part of application No. 10/117,127, filed on Apr. 8, 2002, which is a continuation of application No. 09/791,576, filed on Feb. 26, 2001, now abandoned, which is a continuation-in-part of application No. 09/274,315, filed on Mar. 23, 1999, now abandoned, which is a continuation-in-part of application No. 08/944,476, filed on Oct. 6, 1997, now abandoned, which is a continuation of application No. 08/625,893, filed on Apr. 1, 1996, now abandoned, which is a continuation of application No. 08/240,882, filed on May 10, 1994, now Pat. No. 5,502,901, which is a continuation-in-part of application No. 07/876,777, filed on Apr. 28, 1992, now abandoned, which is a continuation-in-part of application No. 07/673,470, filed on May 17, 1991, now abandoned.

(51) Int. Cl.
*A43B 13/28* (2006.01)

(52) U.S. Cl. ..... 36/12; 36/22 A; 36/22 R; 36/28; 36/29; 36/31

(58) Field of Classification Search ..... 36/12, 36/22 A, 22 R, 28, 29, 31, 27
See application file for complete search history.

(56) References Cited

U.S. PATENT DOCUMENTS

| | | | | |
|---|---|---|---|---|
| 819,449 | A | | 5/1906 | Otterstedt |
| 1,099,180 | A | | 6/1914 | Karacsonyi |
| 1,218,391 | A | | 3/1917 | Gay |
| 1,261,488 | A | | 4/1918 | Cerar et al. |
| 1,506,975 | A | | 9/1924 | Cooney |
| 2,004,906 | A | | 6/1935 | Simister |
| 2,444,865 | A | | 7/1948 | Warrington |
| 2,555,654 | A | | 6/1951 | Ostrom |
| 2,669,038 | A | | 2/1954 | Werth |
| 3,044,190 | A | | 7/1962 | Urbany |
| 3,180,039 | A | | 4/1965 | Burns, Jr. |
| 4,066,602 | A | | 1/1978 | Pellico |
| 4,238,383 | A | | 12/1980 | Anderson |
| 4,457,084 | A | | 7/1984 | Horibata |
| 4,520,138 | A | | 5/1985 | Himes |
| 4,566,206 | A | | 1/1986 | Weber |
| 4,592,153 | A | | 6/1986 | Jacinto |
| 4,629,583 | A | | 12/1986 | Goguen |
| 4,672,754 | A | | 6/1987 | Ehrlich |
| 4,753,021 | A | | 6/1988 | Cohen |
| 4,760,651 | A | | 8/1988 | Pon-Tzu |
| 4,817,304 | A | | 4/1989 | Parker et al. |
| 5,138,776 | A | | 8/1992 | Levin |
| 5,502,901 | A | * | 4/1996 | Brown ..... 36/28 |
| 5,554,694 | A | | 9/1996 | Crow |
| 5,695,850 | A | | 12/1997 | Crow |
| 5,716,723 | A | | 2/1998 | Van Cleef |
| 6,041,520 | A | | 3/2000 | Aoki |

FOREIGN PATENT DOCUMENTS

| | | |
|---|---|---|
| DE | 618719 | 8/1935 |
| GB | 664554 | 1/1952 |
| SU | 1161073 | 6/1985 |

* cited by examiner

*Primary Examiner*—Edward J. Cain
(74) *Attorney, Agent, or Firm*—Shoemaker and Mattare

(57) ABSTRACT

An insert having opposed permanent magnets is placed between upper and lower portions of a shoe sole to soften impacts and improve propulsion. The upper and lower sole portions are interconnected by tongue-and-groove connections. An magnetic spring insert for the heel of a shoe is also disclosed.

8 Claims, 3 Drawing Sheets

FIG. 4
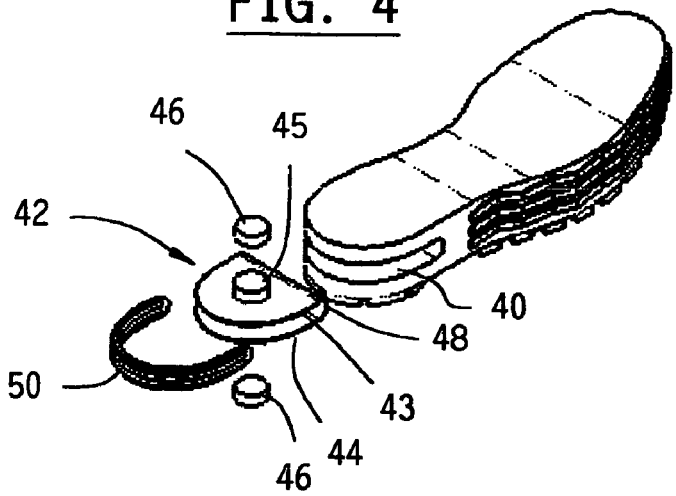
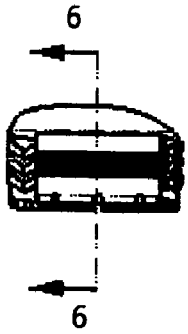
FIG. 5
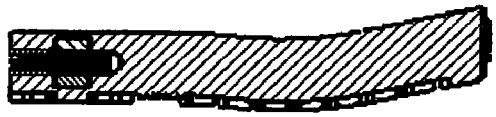
FIG. 6

SHOCK REDUCING FOOTWEAR

CROSS-REFERENCES TO RELATED APPLICATIONS

This application is a continuation-in-part of application Ser. No. 10/117,127 filed Apr. 8, 2002, which is a continuation of application Ser. No. 09/791,576, filed Feb. 26, 2001 (abandoned), which was a continuation-in-part of application Ser. No. 09/274,315 Mar. 23, 1999 (abandoned), which was a continuation-in-part of application Ser. No. 08/944,476, filed Oct. 6, 1997 (abandoned), which was a continuation of Ser. No. 08/625,893, filed Apr. 1, 1996 (abandoned), which was a continuation of Ser. No. 08/240,882, filed May 10, 1994, (now U.S. Pat. No. 5,502,901) which was a continuation-in-part of Ser. No. 07/876,777, filed Apr. 28, 1992, (abandoned) which was a continuation-in-part of application Ser. No. 07/673,470, filed May 7, 1991 (abandoned).

BACKGROUND OF THE INVENTION

This invention relates generally to footwear and is particularly concerned with shoes or boots having shock absorbing or cushioning properties.

Numerous shoe and other footwear designs have been proposed in the past for absorbing shock and adding lift, particularly in the athletic shoe field. U.S. Pat. No. 4,817,304 describes footwear with a cushioning sole structure in which a sealed internal member in the sole is inflated with gas to form a resilient insert in the heel region of the shoe. Various shoe structures have been proposed in the past in which springs are embedded in the shoe sole in the heel region or over the entire sole. See, for example, U.S. Pat. Nos. 5,502,901, 5,138,776, 4,566,206, and 4,592,153. Some of these structures are relatively bulky and heavy, or cannot effectively be manufactured.

SUMMARY OF THE INVENTION

It is an object of the present invention to provide new and improved items of footwear which have improved shock absorbing properties and which also adds lift and propulsion to the foot of a wearer when walking or running.

Permanent magnets are placed in a cavity in the heel in magnetic opposition so that they are repelled from one another and tend to hold the cavity open. These magnetic springs act in conjunction with mechanical (coil) springs to dissipate shock and further add lift and propulsion to the wearer's foot in motion.

The coil springs and magnets together are designed to support an air-flux gap within the sole member at all times. This permits continuous and more effective shock dissipation than when the gap is closed, solid or absent under load.

The springs and magnets work in conjunction to absorb and dissipate load or shock as the foot hits the ground, and subsequently as the person rotates from the heel to the ball of the foot, both the springs and the magnets will bias the opposing walls of the cavity apart, giving lift or propulsion to the shoe wearer.

The shock absorbing insert of this invention may be used in any type of footwear, such as sports/athletic shoes, boots, casual shoes, work shoes, children's shoes, orthopedic shoes, sandals and the like. It will significantly reduce shock to the body while walking, running or in other types of foot motion, and will add lift and propulsion, thereby reducing fatigue.

BRIEF DESCRIPTION OF THE DRAWINGS

In the accompanying drawings,

FIG. 4 is a perspective view of an alternative form of the invention,

FIG. 5 is a rear end view thereof, and

FIG. 6 is a view thereof taken on the plane 6—6 in FIG. 5.

DESCRIPTION OF THE PREFERRED EMBODIMENT

Figure 1:
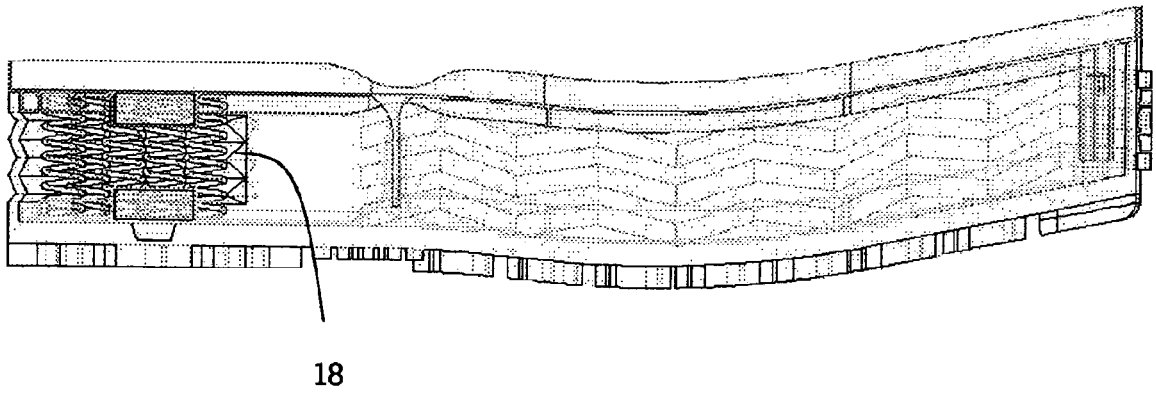
FIG. 1 is a sectional side elevation of a shock reducing shoe embodying the invention.
Figure 2:
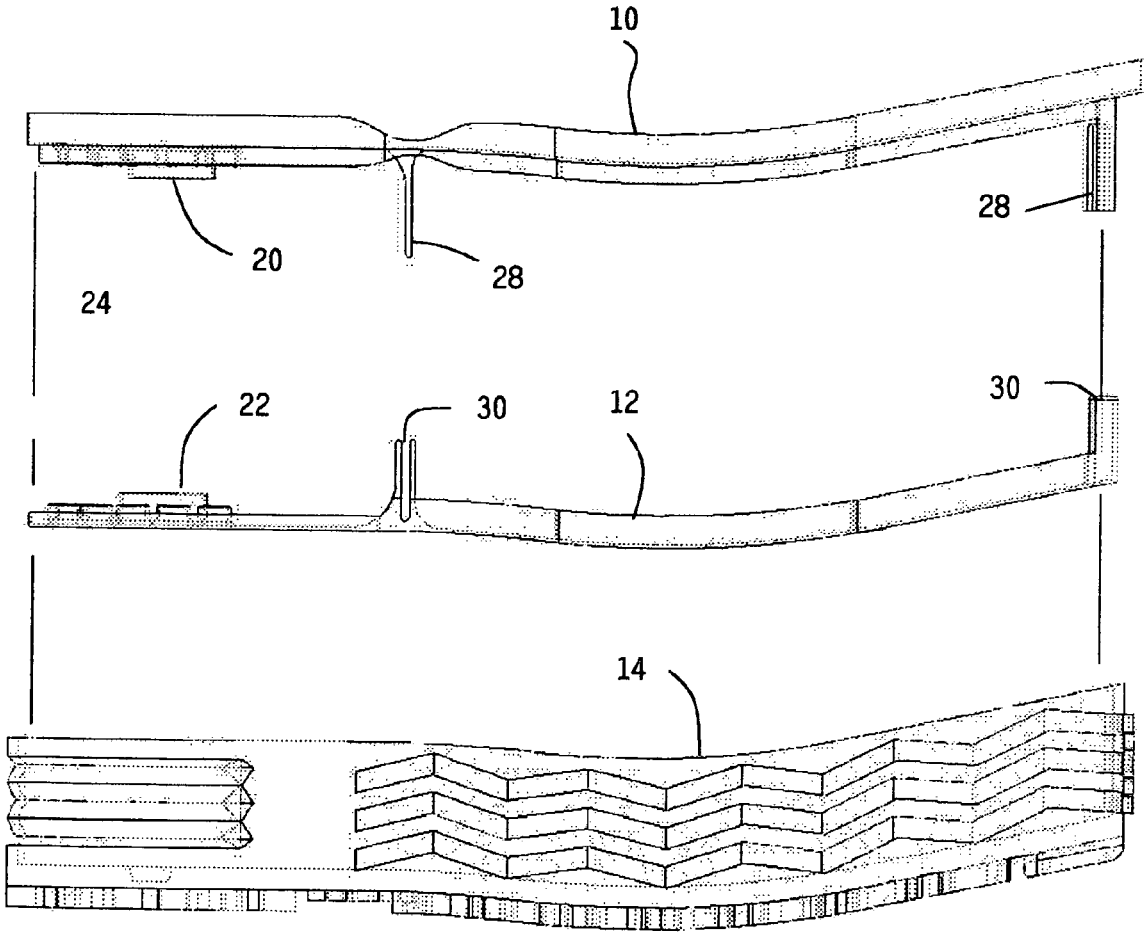
FIG. 2 is an exploded view thereof.
Figure 3:
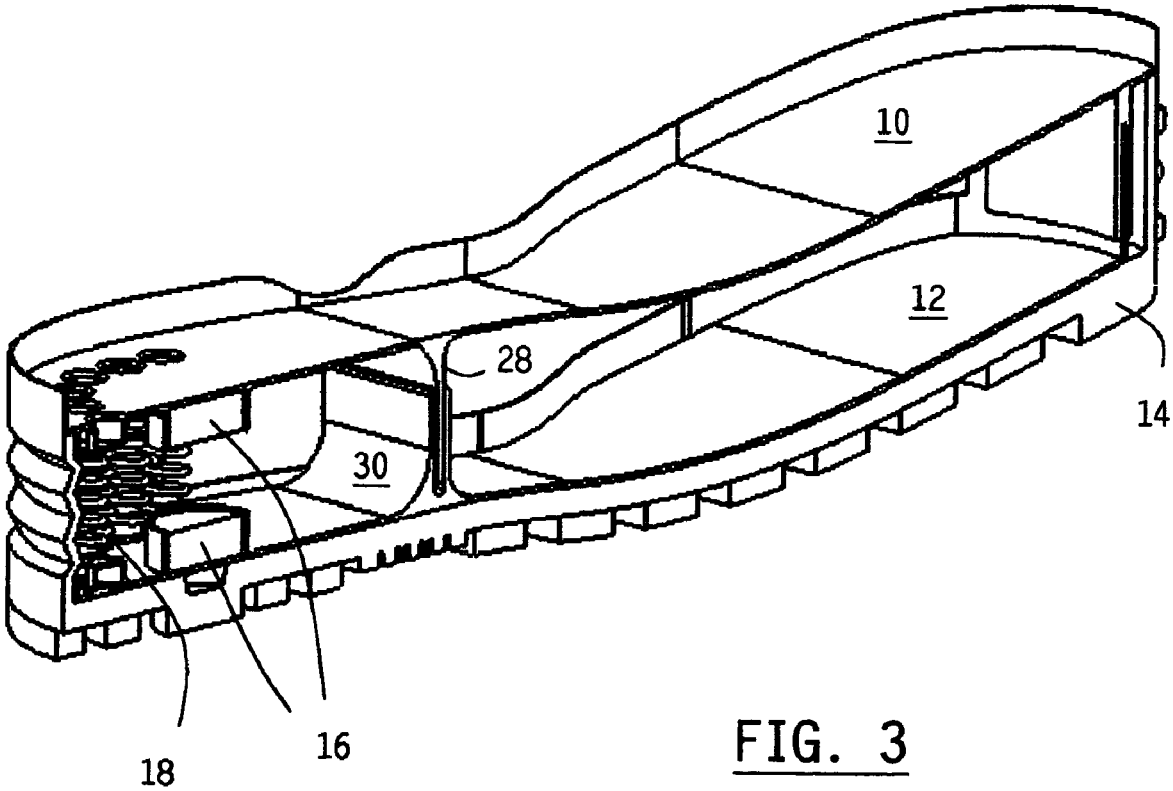
FIG. 3 is a perspective view of the shoe.

A shock reducing shoe or boot, shown in FIGS. 1–3, includes an upper part 10, a lower part 12, and a molded rubber outsole 14, with rare earth super magnets 16 and mechanical compression springs 18 disposed between the upper and lower parts 10 and 12.

While a single pair of magnets is shown, multiple magnet pairs may be used as necessary to meet specific biomechanical load needs. The mechanical springs 18 are added as desired to supplement the magnetic elements. Their number and exact dimensions and spring characteristics are a matter of design choice, which is dependent on the shoe size and the weight of the wearer. The springs should be selected such that they will not be fully compressed under load during normal motion of the wearer. An ordinary person puts two to three times his weight on his foot during motion: if his weight is W and the number of springs is n, each individual spring must be able to support a weight or load of 3W/n without becoming fully compressed, so there will always be some cushioning of the foot while the person is in motion.

A molded magnet holder 20, 22 is provided in each of the parts 10, 12 to prevent accidental magnet-to-magnet contact and resulting damage. Each magnet holder is preferably sized to hold one 0.920" diameter by 0.350" thick single magnet. Posts 24 locate the coil springs.

The upper and lower parts have a tongue-and-groove connection at the toe and similar a similar at the arch. These connections resiliently resist fore-and-aft shearing displacement between the parts. Each connection comprises a generally planar tongue 28 extending substantially perpendicularly from one surface of one of the parts 10, 12 toward the other, and a receptacle 30 formed on the other part. The receptacle comprises a groove having complementary geometry to that of the tongue, so that the tongue and groove have a snug fit when assembled. The tongue and groove provide a large contact area for adhesive which may be applied to either part, or both, to make the assembly permanent.

The drawings show a tongue extending downward from the upper part at the arch, and a receptacle extending downward at the toe, but the polarity of either connection could be changed if desired. The tongue-and-groove design works to control lateral stability and torsional twist under load.

The upper injection molded part 10 itself is designed to achieve shock reduction, its construction and material selection having been optimized by a Finite Element Analysis (FEA). The FEA-determined material is preferably Dupont Super Tough (ST) Nylon 8801 or Dupont ST Nylon 801, which has a high flexural modulus that allows for substantial flexure or depression under load, and returns without losing its shape or form, or breaking. The upper part has a thin (0.077") wall at the heel, to allow for proper biomechanical deflection under dynamic load. This allows the suspension/propulsion spring system to function, while maintaining a usable design shape.

The upper part is thickened to 0.134" in the ball of the foot area to minimize flexure under dynamic load. There is no other mechanical shock system in the ball of the foot area. The upper molded part has a 0.60" thin wall featherline perimeter on its top side that acts as a template guide for glue attachment of a shoe upper. In addition, a 0.60" thin wall rib also runs the perimeter and protrudes down from the top part to allow for a glue attachment to the rubber outsole 14 and acts as protective backing or reinforcement.

The upper and lower molded parts do not extend past the normal perimeter of the shoe, as they did in my previous patent. Everything is contained within the boundary of a typical or normal shoe, thus reducing the danger of side-to-side shoe contact.

The molder rubber outsole 14 is about 0.120" thick, and is preferably made from a highly resilient synthetic rubber having high resilience, light weight, low specific gravity, and resistant to wear, tear, flexure failure and abrasion. Terrain cleats protrude along both sides of the shoe to allow for toe and side traction in difficult ground conditions.

Preferably, he upper sole part has a thin wall protruding downward from and underside of said upper sole part part around the perimeter thereof to provide backing and as a glue attachment surface for the outsole piece, and the lower lower sole part has a thin wall that protrudes upward around the perimeter of the lower part plane to provide backing and a glue attachment surface for the outsole piece.

In an alternative form of the invention (FIGS. 4–6), the shoe sole has a recess 40 which receives a U-shaped heel insert 42. The insert is added to reduce dynamic load force at the heel of the shoe. This insert has a pair of generally planar, parallel arms 42, 44, each of which has a recess 46 for receiving a 0.920"×0.350" rare earth magnet. The arms have thin (0.077") walls, while the insert is thickened at the U-shaped bend 48. The thickness of the insert's material, especially in the U's apex, and the dimensions of the tongue-and-groove connections, determine the load bearing dynamics of the shoe. After the insert is in place, the opening is closed with a molded rubber dust cover 50 which has substantial expandability and acts as a bellows to allow for the flexing of the heel or ball under dynamic load.

Since the invention is subject to modifications and variations, it is intended that the foregoing description and the accompanying drawings shall be interpreted as only illustrative of the invention defined by the following claims.

I claim:

1. A shoe or boot comprising an upper sole part a lower sole part, means for interconnecting the upper sole part and the lower sole part, and an outsole containing said upper and lower sole parts, wherein the interconnecting means comprises at least one tongue-and-groove connection comprising a tongue extending from a first of said parts toward a second of said parts, and an element on the second of said parts, said element having a groove therein for receiving said tongue.

2. The invention of claim 1, wherein the upper sole part has a thin wall protruding downward from and underside of said upper sole part part around the perimeter thereof to provide backing and as a glue attachment surface for the outsole piece, and said lower lower sole part has a thin wall that protrudes upward around the perimeter of the lower part plane to provide backing and a glue attachment surface for the outsole piece.

3. A shoe or boot comprising an upper sole part, a lower sole part, means for interconnecting the upper sole part and the lower sole part, and an outsole containing said upper and lower sole parts, wherein the interconnecting means comprises at least two tongue-and-groove connections, each said connection comprising a tongue extending from a first of said parts toward a second of said parts, and a receptacle on the second of said parts, said receptacle having a groove therein for receiving said tongue.

4. The invention of claim 3, wherein one of said connections is at the toe of the shoe or boot and another of said connections is at the arch thereof.

5. An insert for placement in the heel of a shoe or boot, said insert comprising a U-shaped spring element comprising a pair of substantially planar, generally parallel arm portions interconnected by a U-shaped bend portion, each of said arms having a recess therein for housing a magnet, and magnets of opposite polarity disposed in the recesses, thus providing a non-mechanical spring action for the heel.

6. The invention of claim 5, in combination with a shoe having a sole with a recess in its heel adapted to receive said insert.

7. The invention of claim 6, further comprising a dust cover for sealing said recess.

8. The invention of claim 7, wherein the dust cover has substantial expandability to allow for substantial flexing of the heel under load.

* * * * *